US010189589B2

(12) United States Patent
Mößnang et al.

(10) Patent No.: US 10,189,589 B2
(45) Date of Patent: Jan. 29, 2019

(54) CHAMBER MACHINE WITH GAS NOZZLE MONITORING

(71) Applicant: Multivac Sepp Haggenmüller GmbH & Co. KG, Wolfertschwenden (DE)

(72) Inventors: Konrad Mößnang, Kempten (DE); Benjamin Öfele, Dietmannsried (DE); Thomas Pfalzer, Lautrach (DE); Klaus Rothermel, Unteregg (DE)

(73) Assignee: Multivac Sepp Haggenmueller SE & Co. KG, Wolfertschwenden (DE)

( * ) Notice: Subject to any disclaimer, the term of this patent is extended or adjusted under 35 U.S.C. 154(b) by 525 days.

(21) Appl. No.: 14/918,151

(22) Filed: Oct. 20, 2015

(65) Prior Publication Data

US 2016/0114920 A1 Apr. 28, 2016

(30) Foreign Application Priority Data

Oct. 24, 2014 (EP) ..... 14190229

(51) Int. Cl.

| | |
|---|---|
| ***B65B 31/00*** | (2006.01) |
| ***B65B 31/02*** | (2006.01) |
| ***B65B 31/04*** | (2006.01) |
| ***B65B 51/14*** | (2006.01) |
| ***B65B 57/02*** | (2006.01) |

(52) U.S. Cl.

CPC ..... *B65B 31/024* (2013.01); *B65B 31/02* (2013.01); *B65B 31/04* (2013.01); *B65B 51/14* (2013.01); *B65B 57/02* (2013.01)

(58) Field of Classification Search

CPC ..... B65B 31/00; B65B 31/02; B65B 31/024; B65B 31/04; B65B 31/042; B65B 31/043; B65B 57/02

USPC ..... 53/434

See application file for complete search history.

(56) References Cited

U.S. PATENT DOCUMENTS

| | | | | |
|---|---|---|---|---|
| 3,516,223 | A | 6/1970 | Andersen et al. | |
| 5,555,704 | A * | 9/1996 | Caufield | A61L 2/206 53/425 |
| 2009/0217625 | A1 | 9/2009 | Moessnang | |
| 2011/0068154 | A1* | 3/2011 | Kannankeril | B31D 5/0073 229/68.1 |

FOREIGN PATENT DOCUMENTS

| | | | |
|---|---|---|---|
| CN | 1771188 | A | 5/2006 |
| CN | 201941992 | U | 8/2011 |
| EP | 2093147 | A1 | 8/2009 |
| JP | 2012120766 | A | 6/2012 |
| WO | 9948758 | A1 | 9/1999 |

* cited by examiner

*Primary Examiner* — Andrew M Tecco
*Assistant Examiner* — Chelsea Stinson
(74) *Attorney, Agent, or Firm* — Husch Blackwell LLP

(57) ABSTRACT

The present invention relates to a chamber machine for packaging products in at least one bag, where said chamber machine includes at least one gas nozzle. The chamber machine can also include a monitoring device configured for detecting the presence of a bag neck of the bag over the gas nozzle.

14 Claims, 4 Drawing Sheets

CHAMBER MACHINE WITH GAS NOZZLE MONITORING

CROSS-REFERENCE TO RELATED APPLICATIONS

This Application claims priority to European Patent Application Number 14190229.6 filed Oct. 24, 2014, to Konrad Mößnang et al. entitled "Chamber Machine with Gas Nozzle Monitoring," currently pending, the entire disclosure of which is incorporated herein by reference.

FIELD OF THE INVENTION

The present invention relates to a vacuum chamber machine (i.e. a chamber packaging machine) and to a method of packaging products.

BACKGROUND OF THE INVENTION

European Patent 2 093 147 A1 discloses a belted chamber machine having nozzles that can be introduced into and positioned in bags for gas-flushing a plurality of bags or for allowing a liquid to be injected into these bags. When the bags are placed manually onto the conveyor belt, bags that have not been properly placed may be gas-flushed incorrectly, or not at all, inside the belted chamber machine. In the case of sealed packages having an internal pressure that is similar or equal to the ambient pressure, insufficient gas flushing cannot be detected without using special measurement devices.

Also, in chamber machines in which the bag is manually pulled over a statically fixed gas nozzle, insufficient gas flushing may result from incorrect handling. In the case of medical products, such errors would lead to high failure costs.

SUMMARY OF THE INVENTION

It is the object of the present invention to provide a chamber machine that is capable of detecting gas-flushing errors.

The chamber machine according to one embodiment of the present invention can be used for packaging products in at least one bag and can include at least one gas nozzle and a monitoring device configured for detecting the presence of a bag neck of the bag over the gas nozzle. This can allow for reliable detection of a bag that has been inserted incorrectly by hand as well as a bag that has been mispositioned. This is particularly advantageous in a belted chamber machine with automatic bag feeding. Without these reliable detection measures, at least in the case of sealed bags that have been gas-flushed at ambient pressure, it has, up to now, been impossible to recognize whether a sufficient amount of gas has been introduced in the bag or whether gas has been introduced in the bag at all. Validating the packaging process can be of particular importance, especially when medical products are being packed, so that complicated gas measurements of the already sealed bag can be dispensed later on.

According to one embodiment of the present invention, the monitoring device comprises at least one sensing finger for each gas nozzle, so as to examine on at least one side the presence of a bag pulled over the gas nozzle.

According to one embodiment of the present invention, each gas nozzle or each sensing finger is adapted to have applied thereto an electric voltage, and the gas nozzle is electrically insulated from each sensing finger.

According to one embodiment of the present invention, a control unit is provided, which can be configured for applying to a respective gas nozzle an electric voltage, which may be a DC voltage. The control unit can also be configured for detecting a current that flows between the gas nozzle and a sensing finger, or for measuring the voltage across the sensing finger. The presence of a bag over a gas nozzle can thus be examined in a structurally simple and cost-efficient manner.

According to one embodiment of the present invention, the control unit is configured for indicating an error at a gas nozzle to an operator. The operator can thus be able to sort out the respective bag or to subject it to further examination.

Two sensing fingers can be provided for each gas nozzle. The sensing fingers can be movable relative to the gas nozzle and relative to one another. The movable nature of the sensing fingers can allow, in a situation in which the whole bag is positioned between only one sensing finger and the gas nozzle without being recognized, prevention of an error by requiring two sides of the bag to be pulled over the gas nozzle. This can further improve process reliability and error checking.

The sensing fingers can be configured as spring steel sheets, on the one hand for being electrically conductive and on the other hand for applying a slight pressure to the bag and the gas nozzle. This can allow for electric contact in case of an error without damage being caused to the bag.

According to one embodiment of the present invention, the monitoring device comprises at least one sensor for each gas nozzle. In such an embodiment, the sensor(s) can be an inductive, capacitive or capacitive proximity sensor or an optical sensor.

According to one embodiment of the present invention, a single sensor is provided for each gas nozzle and the single sensor can be configured so as to detect the inflation behavior of the bag at the respective gas nozzle during the evacuation process and the subsequent gas-flushing process. The single sensor can be a touch switch according to one particular embodiment of the present invention.

A method according to one embodiment of the present invention used for packaging products in a bag by means of gas-flushing the bag in a chamber machine is characterized in that the position of a bag neck of the bag over a gas nozzle is monitored by means of a monitoring device. In this way, it can be guaranteed that the exchange of gas in the bag is reliably carried out.

As part of the method, a control unit of the chamber machine can indicate an incorrect position of the bag neck to an operator.

According to a particular embodiment, the control unit of the chamber machine measures an electric current flowing through the gas nozzle and a sensing finger associated with said gas nozzle, or an electric voltage applied between the gas nozzle and an associated sensing finger. In such an embodiment, the presence of a bag over a gas nozzle can be examined in a structurally simple and cost-efficient manner in this way.

According to one embodiment of the present invention, the electric circuit is examined directly after closing of a chamber lid or during the gas-flushing process.

A further step in the method can include execution of an additional examination for validating the electric circuit without a bag being positioned over the gas nozzle, so as to carry out an examination for line fracture of the electric circuits and validate the monitoring device in this way.

Other and further objects of the invention, together with the features of novelty appurtenant thereto, will appear in the course of the following description.

DESCRIPTION OF THE SEVERAL VIEWS OF THE DRAWING

In the accompanying drawing, which forms a part of the specification and is to be read in conjunction therewith in which like reference numerals are used to indicate like or similar parts in the various views.

Like components are provided with like reference numerals in all the figures.

DETAILED DESCRIPTION OF THE INVENTION

Figure 1:
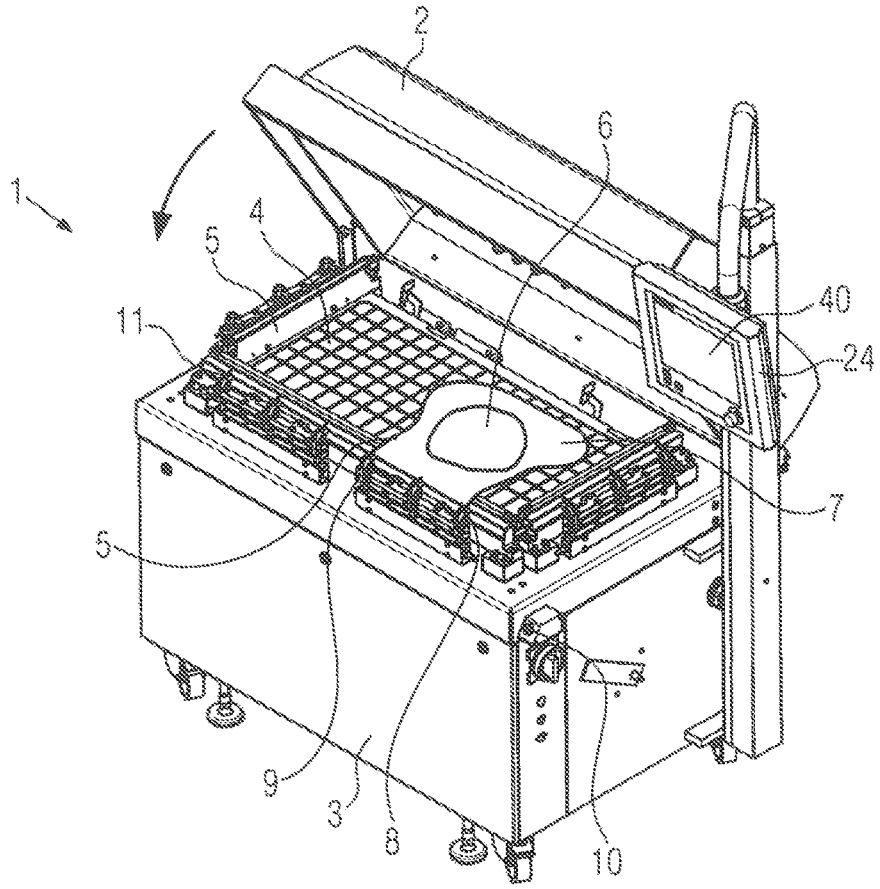
FIG. 1 is a perspective view of a chamber machine according to one embodiment the present invention.

The invention will now be described with reference to the drawing figures, in which like reference numerals refer to like parts throughout. For purpose of clarity in illustrating the characteristics of the present invention, proportional relationships of the elements have not necessarily been maintained in the drawing figures.

The following detailed description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

FIG. 1 shows a vacuum chamber machine 1 according to one embodiment of the present invention with an open chamber lid 2, a frame 3, a chamber base 4 and a plurality of sealing rails 5 on three sides thereof. For packaging a product 6 under a modified atmosphere, the product 6 can be filled into a bag 7 of electrically insulating material and the bag 7 can be placed onto the chamber base 4 in the chamber machine 1 so that the open area of the bag 7, which still is to be sealed, can rest on or be positioned over the sealing rail 5. In this position, the open part of the bag 7, the bag neck 8, can be pulled over a row of gas nozzles 9. When the chamber lid 2 has been closed in the direction of the arrow, the interior of the chamber defined between the chamber lid 2 and the chamber base 4 can be evacuated and the bags 7 can be gas-flushed via the gas nozzles 9 prior to hermetically sealing the bags 7 by means of the sealing rails 5. The chamber lid 2 may be motor driven and activated for closing via a push button 10 or other suitable device.

The gas nozzles 9 can each include a monitoring device 11, which can examine whether the bag neck 8 and the bag 7 have been correctly pulled over the gas nozzle 9 or over a plurality of gas nozzles 9. According to one embodiment, this means that the gas nozzle 9 projects into the bag neck 8 sufficiently far for guaranteeing a reliable gas-flushing of the bag interior.

Figure 2:
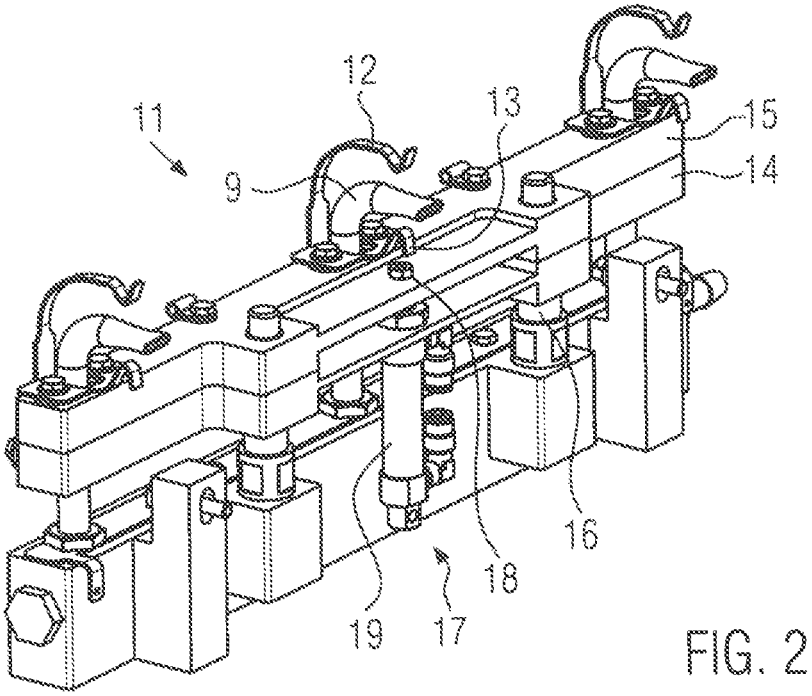
FIG. 2 is a perspective view of a monitoring device at an open position according to one embodiment of the present invention.

FIG. 2 shows the monitoring device 11 at an open position for one and for three gas nozzles 9, respectively. The monitoring device 11 can comprise an upper sensing finger 12 and a lower sensing finger 13 for each gas nozzle 9. The upper sensing finger 12 can be attached to a first bar 14 in an electrically insulated manner and the lower sensing finger 13 can be attached to a second bar 15 in an electrically insulated manner. The two bars 14, 15 themselves can be, in turn, electrically insulated from the gas nozzles 9 and can be configured so that they are vertically movable by means of guides 16. A pneumatic cylinder 17 can have a piston rod 18 connected to the second bar 15 and the cylinder body 19 itself can be connected to the first bar 14. The pneumatic cylinder 17 can cause the first bar 14 and the second bar 15 to move toward and away from each other in a movement relative to one another.

Figure 3:
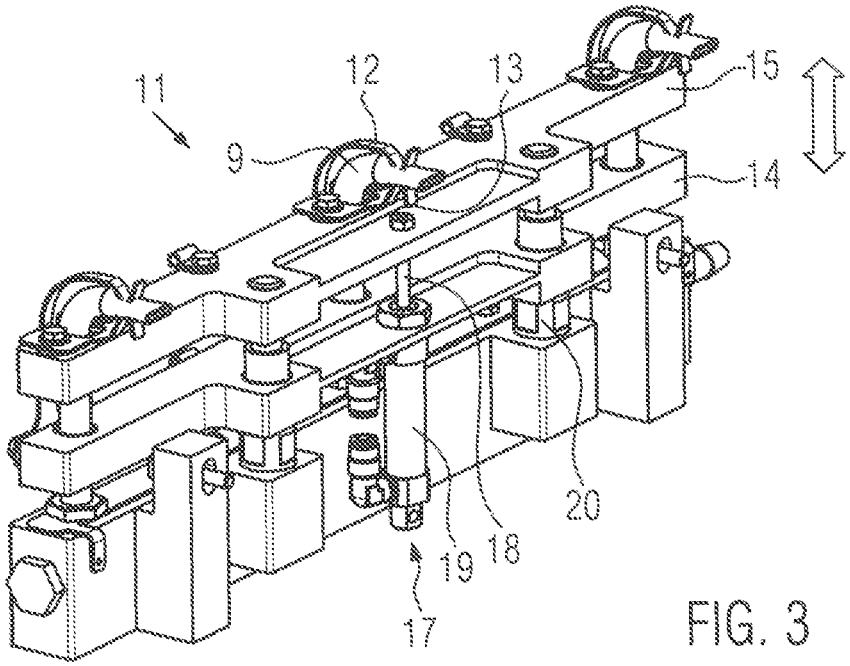
FIG. 3 is a perspective view of a monitoring device at a closed position according to one embodiment of the present invention.
Figure 4:
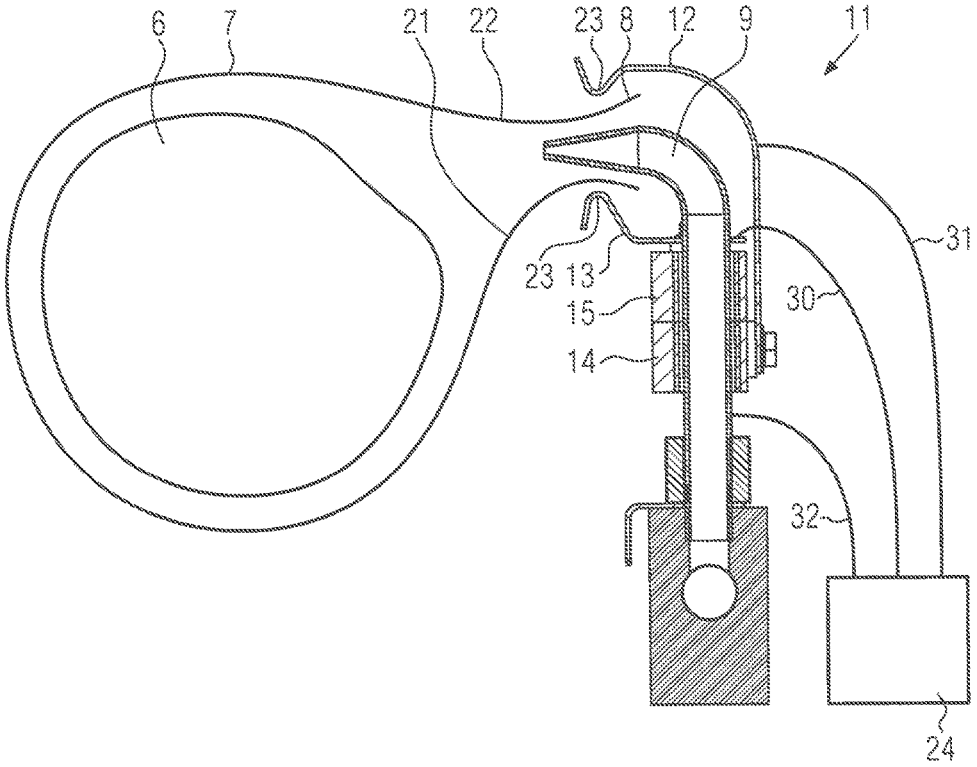
FIG. 4 is a side elevation sectional view of the monitoring device of FIG. 2 at an open position with an attached bag according to one embodiment of the present invention.

Making reference to FIG. 3, the sequence of movements of the bars 14, 15 and of the sensing fingers 12, 13, respectively, will be explained in more detail. The activated pneumatic cylinder 17 can extend its piston rod 18 and, in so doing, push the first bar 14 downwards into contact with a stop 20. The upper sensing finger 12, which can be attached to the first bar 14, can thus be caused to approach the gas nozzle 9 to such an extent that the sensing finger 12, which can consist of a spring steel sheet, presses against the gas nozzle 9. As the extension movement of the piston rod 18 continues, the cylinder body 19 can come to rest on the stop 20 via the first bar 14 and also push the second bar 15 with the lower sensing finger 13 into contact with the gas nozzle 9. At this position, it can be examined whether a bag 7 correctly abuts on the gas nozzle 9 from above with a first side 22 thereof and from below with a second side 21 thereof, as best shown in FIG. 4. The bag neck 8 can here be pulled over the gas nozzle 9 at least up to the respective point of contact 23, as best shown in FIG. 5, between the sensing fingers 12, 13 and the gas nozzle 9.

FIG. 4 shows a sectional view of the monitoring device 11 comprising a single gas nozzle 9, the two sensing fingers 12, 13 and the two bars 14, 15. The two sensing fingers 12, 13 and the gas nozzle 9 can each be electrically insulated from one another and each can be connected to a control unit 24. The control unit 24 can apply a DC voltage, such as 5 V or 24 V or other applicable voltage, to a connection line 30 to the gas nozzle 9 and can measure an electric voltage at the respective connection lines 31, 32 to the sensing fingers 12, 13. FIG. 4 also shows a correctly inserted bag 7 having its bag neck 8 pulled over the gas nozzle 9 so that the first side 22 and the second side 21 of the bag neck 8 project beyond the gas nozzle 9 farther than the point of contact 23 between the sensing fingers 12, 13 and the gas nozzle 9 shown in FIG. 5.

Figure 5:
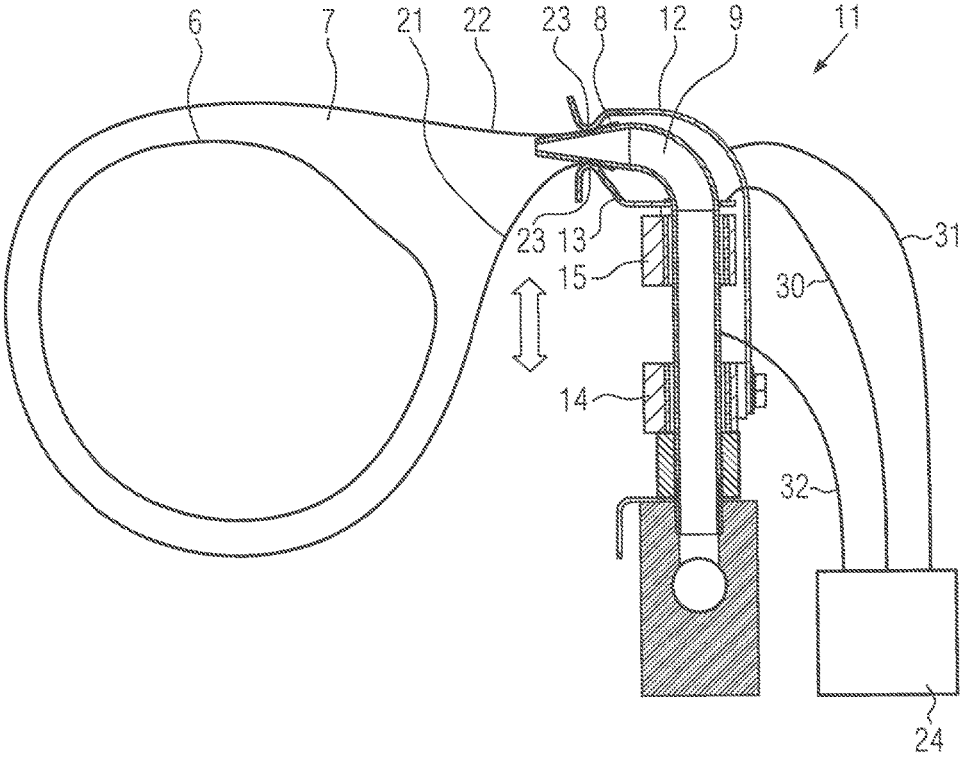
FIG. 5 is a side elevation sectional view of the monitoring device FIG. 3 at a closed position with an attached bag according to one embodiment of the present invention.

FIG. 5 shows the monitoring device 11 at its closed or examination position. In this position the bars 14, 15 have been moved apart, the bar 14 can be in contact with the stop 20 and the sensing fingers 12, 13 can press against the gas nozzle 9 and the first and second sides 22, 21 of the bag neck 8, respectively. When the first side 22 of the correctly inserted bag neck 8 is positioned between the first sensing finger 12 and the gas nozzle 9, the control unit 24 can recognize that no current or only a minimum current flows across the gas nozzle 9 having the voltage applied thereto, or that the connection line 31 to the upper sensing finger 12 does not have applied thereto any voltage, since the bag 7, which can consist of plastic material, can have an insulating effect. This can apply analogously also to the second sensing finger 13. The control unit 24 can evaluate this result as a correctly inserted bag 7.

In the event that at least one side 21, 22 has not been pulled over the gas nozzle 9 to a sufficient extent or no bag 7 at all has been inserted, this mispositioning can be detected, since at least one sensing finger 12, 13 can be electrically connected to the gas nozzle 9 directly at the point of contact 23 and the control unit 24 can measure the voltage or detect a flow of current at the connection line 31, 32 to a sensing finger 12, 13 because the insulating effect produced by the bag 7 is missing. The control unit 24 can detect this error and can display it on a display 40 (as shown in FIG. 1) of the control unit 24 of the chamber machine 1. The operator can thus decide whether a gas-flushed and sealed bag 7 has to be re-examined in some other way or sorted out.

The monitoring device 11 can also be examined for a fracture of the electric connection lines 31, 32 or for contamination of the gas nozzles 9 by moving the sensing fingers 12, 13 to the examination position prior to insertion of the bag 7 or after removal of the bag 7 from the chamber machine 1 while the control unit 24 carries out a successful voltage or current measurement. If one of the connection lines 31, 32 should be interrupted or if one of the sensing fingers 12, 13 should be, for example distorted, the control unit 24 can determine this by means of the monitoring device 11.

Another possibility of examination is given during removal of the bags 7. If the sensing fingers 12, 13 still occupy the examination position, a voltage between the sensing fingers 12, 13 and the gas nozzles 9 can be measurable at the moment of removal.

In the event that the chamber machine 1 is configured as a belted chamber machine comprising a conveyor belt and automatically positionable gas nozzles 9, the above described examination can be carried out automatically prior to feeding new bags 7 or after the discharge of bags 7 that have already been gas-flushed and sealed.

It is also imaginable that the presence of bags 7 in the chamber machine 1 can be examined by the control unit 24 by means of sensors, preferably light barriers. In this case, only the errors of not correctly inserted bags 7 are likely displayed to the operator by the display 40 and errors caused by the absence of bags 7 are likely neglected by the control unit 24 and not displayed on the display 40.

In addition, it is imaginable that gas lines leading to the gas nozzles 9 can be opened by means of valves for the purpose of gas-flushing only if the correct application of a bag 7 has been ascertained for the respective gas nozzles 9.

The chamber machine 1 can also comprise a belted chamber machine in which the bags 7 filled with a product 6 are conveyed into the chamber by means of a conveyor belt in alternative embodiments of the present invention.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions and methods described above and illustrated in the drawings are presented by way of example only and are not intended to limit the concepts and principles of the present invention. Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereto, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A chamber machine for packaging products in at least one bag, said chamber machine comprising:

at least one gas nozzle; and a monitoring device configured for detecting the presence of a bag neck of said at least one bag over said at least one gas nozzle;

wherein said monitoring device comprises two sensing fingers for each of said at least one gas nozzle; and wherein said two sensing fingers are movable relative to said at least one as nozzle and said two sensing fingers are movable relative to one another.

2. The chamber machine according to claim 1, wherein said at least one gas nozzle or said two sensing fingers are adapted to have applied thereto an electric voltage, and wherein said at least one gas nozzle is electrically insulated from said two sensing fingers.

3. The chamber machine according to claim 2 further comprising a control unit configured for applying to said at least one gas nozzle an electric voltage and configured for detecting a current flowing between said at least one gas nozzle and said two sensing fingers.

4. The chamber machine according to claim 2 further comprising a control unit configured for measuring a voltage across at least one of said two sensing fingers.

5. The chamber machine according to claim 1 further comprising a control unit configured for indicating an error at said at least one gas nozzle to an operator.

6. The chamber machine according to claim 1, wherein at least one of said two sensing fingers is configured as a spring steel sheet.

7. A method of packaging products in a bag by means of gas-flushing said bag in a chamber machine, said method comprising the steps of:

positioning a bag neck of said bag over a gas nozzle of said chamber machine; and monitoring said position of said bag neck using a monitoring device;

wherein said step of monitoring said position of said bag neck using said monitoring device comprises measuring, using at least one sensing finger of said monitoring device, at least one of an electric current and an electric voltage using an electric circuit provided between one of said at least one sensing fingers and said gas nozzle.

8. The method according to claim 7 further comprising the step of indicating an incorrect position of said bag neck to an operator by means of a control unit of said chamber machine.

9. The method according to claim 7 further comprising the step of examining said electric circuit directly after closing a chamber lid of said chamber machine.

10. The method according to claim 9 further comprising the step of examining said electric circuit a second time without said bag being placed over said gas nozzle.

11. The method according to claim 7 further comprising the step of examining said electric circuit while gas-flushing said bag in said chamber machine.

12. The method according to claim 11 further comprising the step of examining said electric circuit a second time without said bag being placed over said gas nozzle.

13. A chamber machine for packaging products in at least one bag, said chamber machine comprising:

at least one gas nozzle; and a monitoring device configured for detecting the presence of a bag neck of said at least one bag over said at least one gas nozzle;

wherein said monitoring device comprises at least one sensing finger for each of said at least one gas nozzle; and wherein said at least one gas nozzle or said at least one sensing finger is adapted to have applied thereto an electric voltage, and wherein said at least one gas nozzle is electrically insulated from said at least one sensing finger.

14. A chamber machine for packaging products in at least one bag, said chamber machine comprising:

at least one gas nozzle;

a monitoring device configured for detecting the presence of a bag neck of said at least one bag over said at least one gas nozzle;

wherein said monitoring device comprises at least one sensing finger for each of said at least one gas nozzle; and wherein said at least one sensing finger is configured as a spring steel sheet.

* * * * *